US005452880A

United States Patent [19]

Bailey

[11] Patent Number: 5,452,880

[45] Date of Patent: Sep. 26, 1995

[54] FENCE COUPLING

[76] Inventor: William Bailey, 461 Springwood Rd., Daisy Hill, Queensland 4127, Australia

[21] Appl. No.: 109,342

[22] Filed: Aug. 19, 1993

[30] Foreign Application Priority Data

| | | | |
|---|---|---|---|
| Aug. 21, 1992 | [AU] | Australia | PL4224 |
| Dec. 11, 1992 | [AU] | Australia | PL6282 |

[51] Int. Cl.[6] ..... E04H 17/22

[52] U.S. Cl. ..... 256/67; 256/69; 256/65; 256/60; 256/24; 256/26; 256/27

[58] Field of Search ..... 256/65, 67, 68, 256/69, 59, 60, 24, 26, 27, 1; 403/79

[56] References Cited

U.S. PATENT DOCUMENTS

| | | | |
|---|---|---|---|
| 3,096,079 | 7/1963 | Winn . | |
| 3,157,388 | 11/1964 | Nelson . | |
| 3,195,864 | 7/1965 | Case . | |
| 3,204,898 | 9/1965 | Manning . | |
| 3,206,235 | 9/1966 | Albinson et al. . | |
| 3,385,567 | 5/1968 | Case et al. | 256/24 |
| 3,395,489 | 8/1968 | Banse | 256/24 |
| 3,410,527 | 11/1968 | Uroshevich . | |
| 3,815,877 | 6/1974 | Turner . | |
| 3,960,367 | 6/1976 | Rogers . | |
| 4,015,826 | 4/1977 | Lauzier . | |
| 4,225,120 | 9/1980 | McLaughlin | 256/24 |
| 4,266,757 | 5/1981 | Kirkwood . | |
| 4,498,660 | 2/1985 | Brema et al. . | |
| 4,645,183 | 2/1987 | Rattray et al. | 256/26 |
| 4,659,053 | 4/1987 | Holley et al. . | |
| 4,951,925 | 8/1990 | Schultz et al. . | |
| 4,982,933 | 1/1991 | Schultz . | |
| 4,986,513 | 1/1991 | Schultz et al. . | |

FOREIGN PATENT DOCUMENTS

| | | | |
|---|---|---|---|
| 4951579 | 5/1982 | Australia . | |
| 2016883 | 12/1984 | Australia . | |
| 3742985 | 7/1988 | Australia . | |
| 6201086 | 7/1989 | Australia . | |
| 628196 | 7/1990 | Australia . | |
| 8680391 | 10/1991 | Australia . | |
| 1099392 | 2/1992 | Australia . | |
| 5916290 | 9/1992 | Australia . | |
| 1055289 | 5/1979 | Canada | 256/24 |
| 0572556 | 2/1976 | Switzerland | 256/67 |
| 2005325 | of 0000 | United Kingdom . | |
| 1008216 | 10/1965 | United Kingdom | 256/67 |

*Primary Examiner*—Thomas E. Denion
*Assistant Examiner*—Christopher Verdier
*Attorney, Agent, or Firm*—Mathews, Woodbridge & Collins

[57] ABSTRACT

The present invention relates to a coupling (10) for connecting railing members (170, 171) to post (14, 15). The coupling (10) has a mounting portion having two parts (16, 117) pivotally movable relative to one another and capable of being locked against pivotal movement by a fastener (35, 113). Railing connection members (22, 25) are pivotally coupled to parts (16, 17) about axes (24, 26) extending transversely of the members and to an axis (20) about which the parts (16, 17) may pivot relative to one another.

14 Claims, 8 Drawing Sheets

Fig.9.
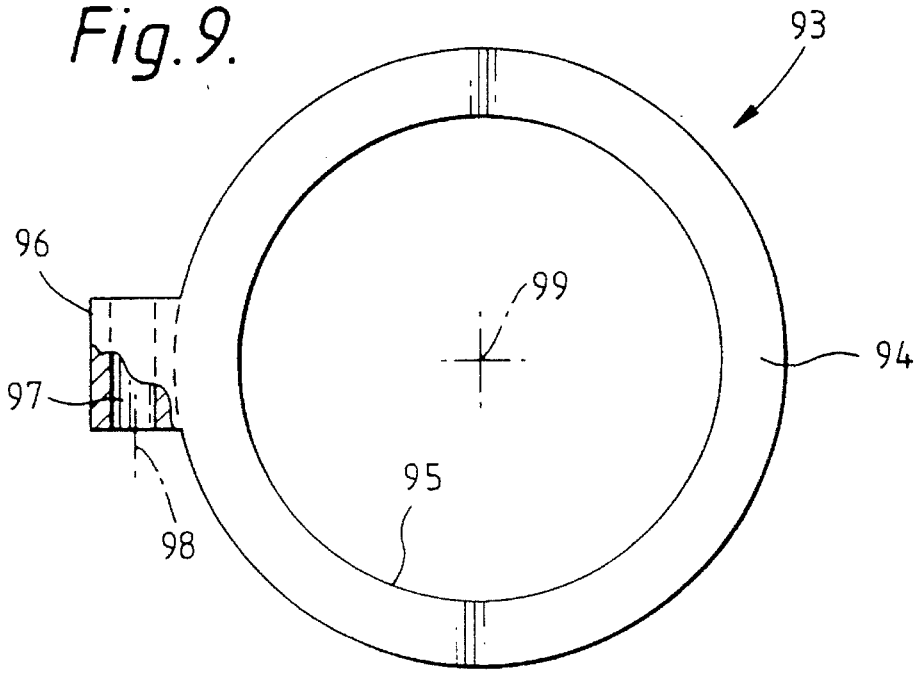
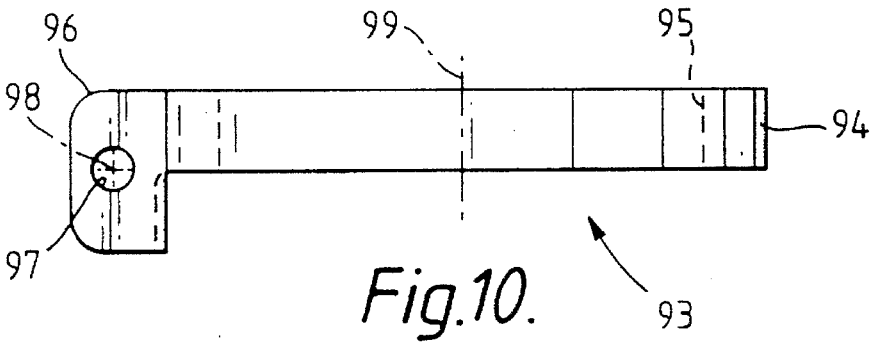
Fig.10.
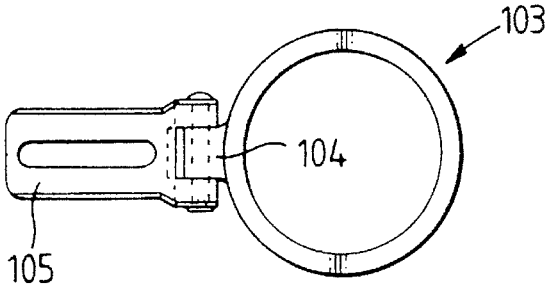
Fig.11.

FENCE COUPLING

BACKGROUND OF THE INVENTION

THE PRESENT INVENTION relates to a coupling for connecting railing members to a post such that the posts and railing members may adopt any configuration and adapt to any terrain. In particular, although not exclusively, the present invention relates to a coupling for constructing a fence which readily lends itself to connecting prefabricated fencing components.

The coupling will be described by way of example with reference to its use in constructing a fence. It should be appreciated that this is by way of example only and that the coupling may be used to construct barriers, signs, partitions or the like.

Fence couplings which allow a fence railing to pivot with respect to the fence post about both a horizontal and a vertical axis are known. U.S. Pat. No. 3,960,367 discloses brackets in the form of collars which encircle posts and are pivotally connected to rails and can be adjusted on the posts both vertically and rotationally. The disadvantage of such brackets is that the collars are only maintained in position on the posts by virtue of friction and following assembly, the collars may become misaligned especially if a heavy blow is applied to the fence railing. In assembling a fence using the collar of the above patent, it is necessary to conduct measurements to determine the desired location of the collars along the posts. A further disadvantage of this bracket is that the ends of the fence railing are left exposed and as a result the construction is not aesthetically pleasing.

Australian Patent Application No. 20168/83 discloses a fence coupling comprising a fitting clasped around a vertical fence post and located by means of a fastener. A socket is formed in the fitting and a ball member is receivable therein. The ball member is connectable to a fence railing. This arrangement has similar disadvantages to the abovementioned United States patent in that a heavy blow to the fence railing may cause misalignment of the fence railing between adjacent posts or may even cause the ball to pop out of the socket. A further disadvantage is that measurements must be made on assembly to determine the location of the fitting on the fence post. This does not easily lend itself to simple assembly of prefabricated fencing components.

Australian Patent Application No. 59162/90 discloses a similar ball and socket fence coupling. However, in this case, the ball member is attached to a plate affixed to the fence post by fasteners and the socket member is connected to the railing member. As with other prior art, this fence coupling requires measurements to be made during assembly of the fence. A major disadvantage of this construction is that pivotal motion in a horizontal plane to allow a fence constructed using the coupling to adopt any configuration, occurs about a vertical axis which is spaced from the centre of the post. This feature may give rise to some difficult geometric problems when designing the fence.

U.S. Pat. No. 3,410,527 discloses a fence coupling comprising a semi-circular snap ring, the ends being rotatably mounted in bearing holes in the fence post. These snap rings may be held at any angle within an arc of 110° taken from the centre of the bearing holes. The snap rings are loosely retained in a rectangular opening of a terminal cap which is connected to the fence railing. The loose retention of the snap ring permits positioning of the fence rail within a horizontal arc of 190°. Again, the pivotal motion of the railing in a horizontal direction is not centred at the centre of the post and therefore difficult geometric problems may also arise in designing a fence using the disclosed fence coupling. Further, the fact that the terminal caps are loosely retained on the snap rings could result in a fence of weak construction.

OBJECT OF THE INVENTION

It is an object of the present invention to overcome or at least ameliorate some of the disadvantages of the prior art.

The term "fence" used throughout this specification denotes not only fences as such but also includes partitions, balustrades, barriers, dividers signs and the like.

SUMMARY OF THE INVENTION

According to one aspect, the invention provides a coupling for attaching railings to a post, the coupling including a mounting portion attachable to extend across the post, the mounting portion having at least two parts pivotally movable relative to one another and capable of being locked against relative pivotal movement, a respective railing connection member pivotally coupled to each of the parts of the mounting portion and about axes extending transversely of the members, the members being adapted for attachment to railings.

In one embodiment, the parts of the mounting portion may comprise plates pivotally coupled to each other by a pivot member. The pivot member may be a pin or fastener such as a bolt. Where the parts are in the form of plates, these may have any suitable shape when viewed in plan. Preferably, the plates are circular when viewed in plan although other shapes may also be employed.

In an alternative embodiment the mounting portion comprises parts having complementary engagements and the axis about which the parts may pivot relative to one another extends through the complementary engagements. The complementary engagements may comprise engaging extensions coupled to each other by a pivot pin or fastener. Preferably, one of the parts has two spaced extensions and the other part has one extension receivable between the spaced extensions of the other part. A pin or fastener provides the pivotal coupling between the parts of the mounting portion. In plan, the parts may be rectangular in shape. It is preferred that the ends of the parts comprising the complementary engagements are curved when viewed in plan.

The axis about which the parts of the mounting portion pivot may be at right angles to the transverse axes about which the attachment members are pivotally coupled to the mounting portion. Further, the axis about which the parts of the mounting portion pivot may extend along the post to which it is attached. Preferably, this axis coincides with the central longitudinal axis of the post.

The parts of the mounting portion may be locked against relative pivotal movement by the use of a fastener assembly such as a nut and bolt. Preferably, the fastener assembly also serves as the means for pivotal connection between the parts. The mating faces of the parts may be substantially planar such that the fastener holds the parts against relative pivotal movement by frictional engagement. Alternatively, the mating faces of the parts may have complementary grooves and ridges such that when the fastener assembly is tightened, the parts are held more securely against pivotal movement. Preferably, the complementary grooves and ridges extend radially.

Each railing connection member may be pivotally coupled to a respective part of the mounting portion, preferably by a pivot pin. The railing connection members may be bar-like in form.

In some circumstances, for example where the fence is subject to high wind loading, it may be necessary to anchor the lower end of the post firmly in the ground and it may be undesirable to break the post at a point midway in order to mount a lowermost coupling.

Where the posts are cylindrical, this problem may be overcome by the use of brackets in the form of collars which encircle the post and are pivotally connected to the rails. Such brackets are disclosed in U.S. Pat. No. 3,960,367. The collars can be adjusted both vertically and rotationally. However, where posts of square or rectangular cross section are utilised, problems are encountered because the collars must be more or less circular so as to be rotatably adjustable but it is difficult to secure a circular collar to a square post.

In accordance with another aspect of the present invention, there is disclosed a mounting bracket for providing a mounting for a coupling of the type described in relation with the first aspect of the invention, the mounting bracket comprising a pair of sleeves each with an internal periphery corresponding to the external periphery of the post and a retaining member, the sleeves having one or more projections such that in use the projections define a part of an imaginary continuous external curved surface extending between the retaining members.

In practice, posts with which the bracket may be used will be rectangular or square in cross-section. Therefore the sleeves in practice will have an internal bore which is square or rectangular in cross-section. Preferably, there is a sliding fit relationship between the sleeves and the posts such that during assembly, each sleeve may be slid to a desired location along the post. In use the sleeves may be fixed in relation to the post. Alternatively, the sleeves may be located on the post by means of an extension from the post such as a crimp.

The projections are intended to provide a mounting for components having corresponding internal curved surfaces such as collars of U.S. Pat. No. 3,960,367. The retaining members retain such components therebetween. Each retaining member may comprise a flange extending outwardly from the sleeve. Preferably, the flange is a continuous annular flange. In use, the distance between the retaining members, in other words the collective width of the curved surfaces, corresponds to the collective width of the components to be mounted therebetween.

The projections may extend from one of the sleeves or both. Preferably the projections extending from each of the sleeves and are complementary. The imaginary continuous curved surface may be cylindrical. Preferably the longitudinal axis of the cylindrical curved surface is coaxial with the longitudinal axis of the internal bore of the sleeves. There may be pairs of diametrically opposed projections. It is preferred that there is a pair of diametrically opposed projections extending from each sleeve.

The sleeves may be identical to each other. This is an important manufacturing consideration as only one die need be made to form each of the sleeves. In use, the sleeves are held in fixed relation to each other. The sleeves may be adapted to clamp together. The sleeves may be releasably clampable. The mounting bracket may be held in fixed relation to the post by any suitable means.

BRIEF OF DRAWINGS

Some embodiments of the present invention will now be described by way of example with reference to the drawings in which:

FIG. 9 is a partial sectional view of a coupling which may be used with the mounting bracket of the preferred embodiment;

FIG. 10 is a side view of the coupling of FIG. 9;

FIG. 11 is a plan view of an alternative coupling which may be used with the mounting bracket of FIGS. 6 to 8;

DESCRIPTION OF THE PREFERRED EMBODIMENT

Figure 1:
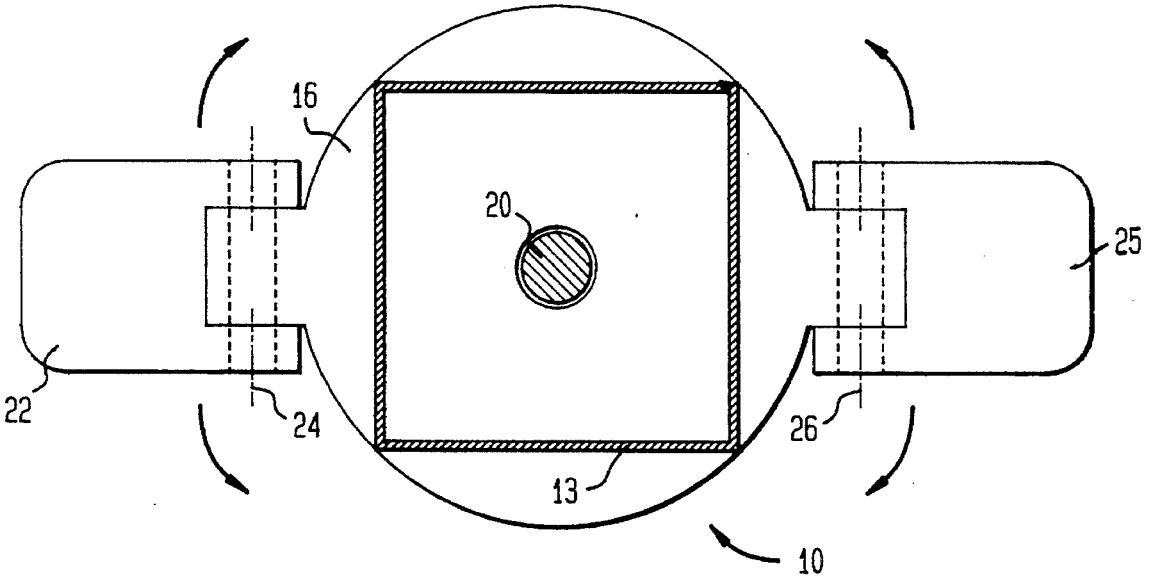
FIG. 1 is a partial sectional view of a coupling of a first preferred embodiment.
Figure 2:
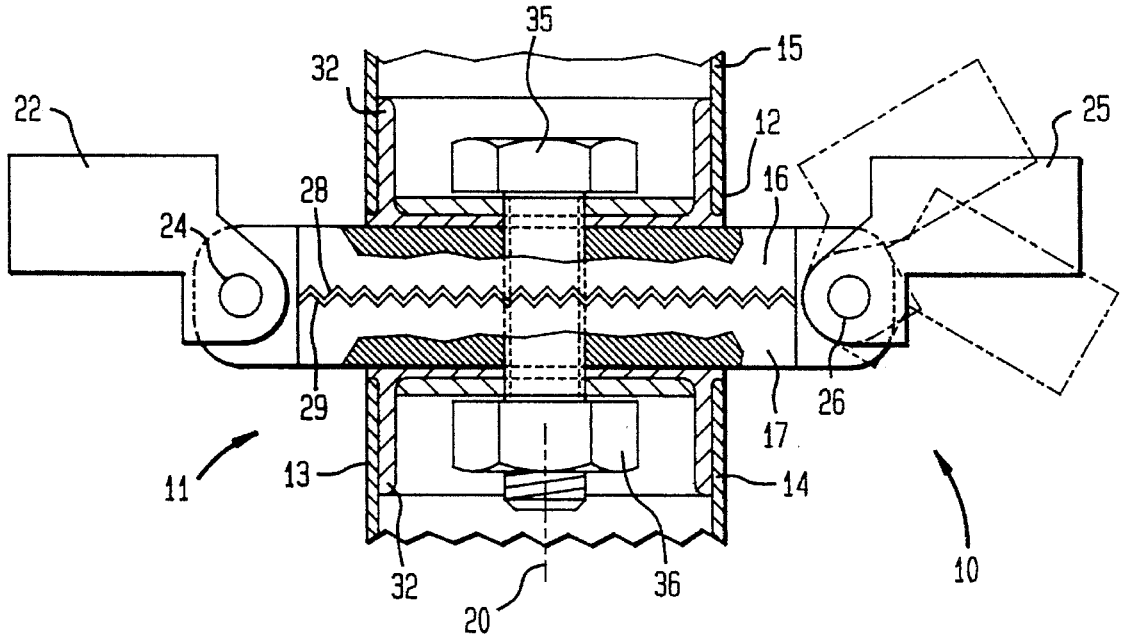
FIG. 2 is a side elevation of the coupling of FIG. 1.

A first preferred embodiment of a coupling 10 is illustrated in FIGS. 1 and 2. The coupling 10 includes a mounting portion including upper and lower plates 16, 17. The plates 16, 17 are pivotable relative to one another about a first axis 20, which coincides with the central longitudinal axis of fence post 14. The plates 16, 17 pivot about bolt 35. Upper plate 16 has a first railing connection member 22 pivotally connected thereto about a second axis 24 extending transversely of the member 22. Lower plate 17 has a second railing connection member 25 pivotally connected thereto about a third axis 26 extending transversely of the member 25. Second and third axes 24, 26 are perpendicular to first axis 20. The railing connection members 22, 25 may pivot 45° above and 90° below the horizontal. Upper plate 16 and lower plate 17 can include ridges 28 and grooves 29 for complementary mating of upper plate 16 and lower plate 17. With one plate and associated railing connection member held stationary, the other plate and railing connection member may pivot through an arc of about 270° about the first axis 20.

The coupling 10 may be used to construct a fence having spaced fence posts 14, upper and lower railing members extending between the fence posts and upright members extending between the railings. Alternatively, the coupling may be used to construct a fence with only an upper railing member extending between the fence posts. In the latter case, one coupling 10 would be required at spaced locations along each fence post.

Posts 14 and 15 may be connected to coupling 10 by end members 32. End members 32 may be secured to the ends 12, 13 of posts 15, 14 by suitable fasteners or be welded thereto.

Figure 3:
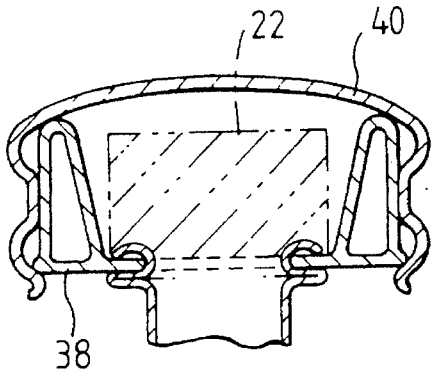
FIG. 3 is a cross-sectional view of an assembled upper railing member, cover member and upright member securable to a post which may be included in a fence incorporating the coupling of the invention.

FIG. 3 shows the railing connection member 26, attached to the upper surface of an upper railing member 38 by suitable fasteners (not shown). Cover member 40 snap fits over the railing connection member 22 and upper railing member 38 to improve the aesthetic appearance. A lower railing member may be employed where a fence is constructed having lower railing members. The railing connection members 22, 25 are attached to the undersurface of the lower railing members by suitable fasteners.

Uprights may extend between the upper and lower railing members and be connected to them.

Figure 4:
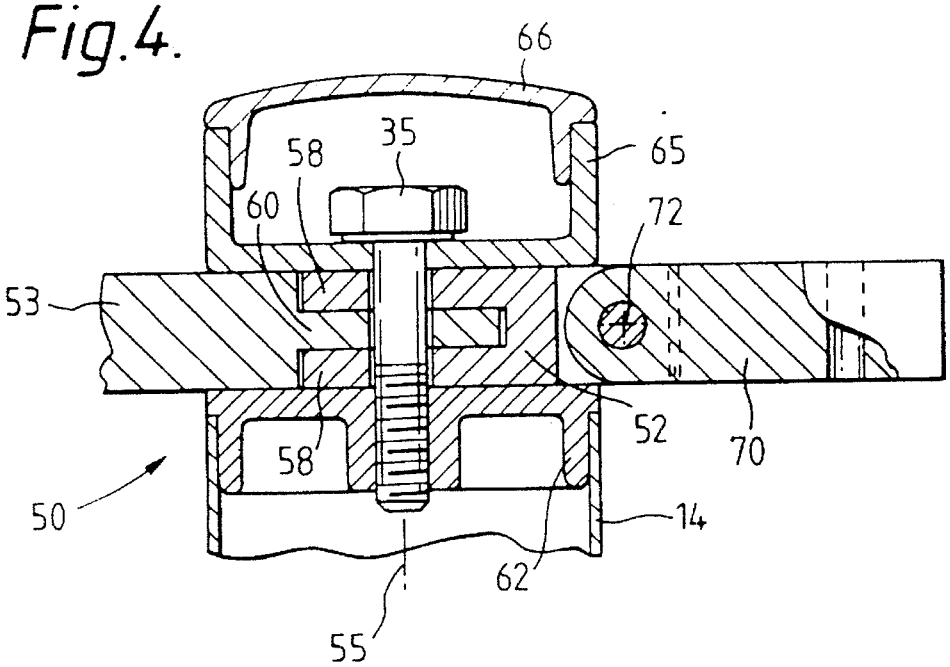
FIG. 4 is a cross-sectional view of a coupling of a second preferred embodiment.
Figure 5:
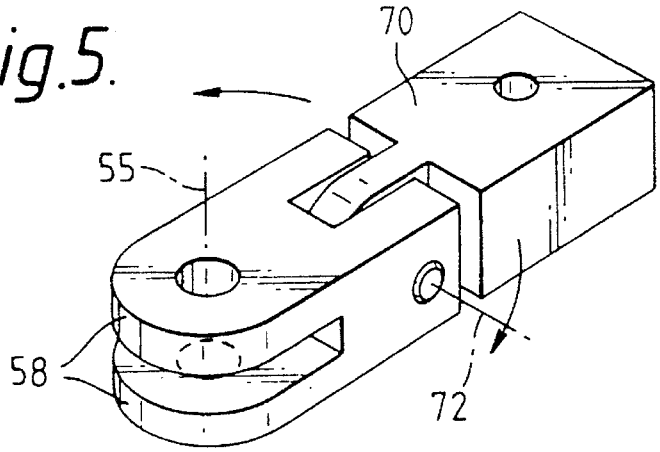
FIG. 5 is a perspective view of part of the coupling shown in FIG. 4.

FIG. 4 illustrates an alternative coupling 50 which comprising first and second members 52, 53. The coupling is shown extending across the upper end of a fence post 14 for connecting an upper railing member (not shown) to the post 14. First member 52 has a pair of spaced extensions 58 and the second member 53 has single extension 60 which extends between the pair of spaced extensions 58. The first and second members 52, 53 pivot about a bolt 35 which extends through the extensions and along the central axis 55. Bolt 35 threads into mounting plate 62 which is fixed to the end of the fence post 14. The bolt 35 also extends through a fence cap mounting portion 65 which receives a fence cap 66. On tightening of the bolt 35, the fence cap mounting portion 65, first and second members 52, 53 and the mounting plate 62 are secured together and the first and second members are locked against relative pivotal movement. The first member 52 is shown with a railing connection member 70 pivotally connected to it about a transverse axis 72. Second member 53 may also have a railing connection member pivotally connected thereto in a similar fashion. It will be appreciated that coupling 50 may also be used to connect a lower railing member to a fence post in a similar fashion to the coupling described above in accordance with the first preferred embodiment of the invention.

Figure 6:
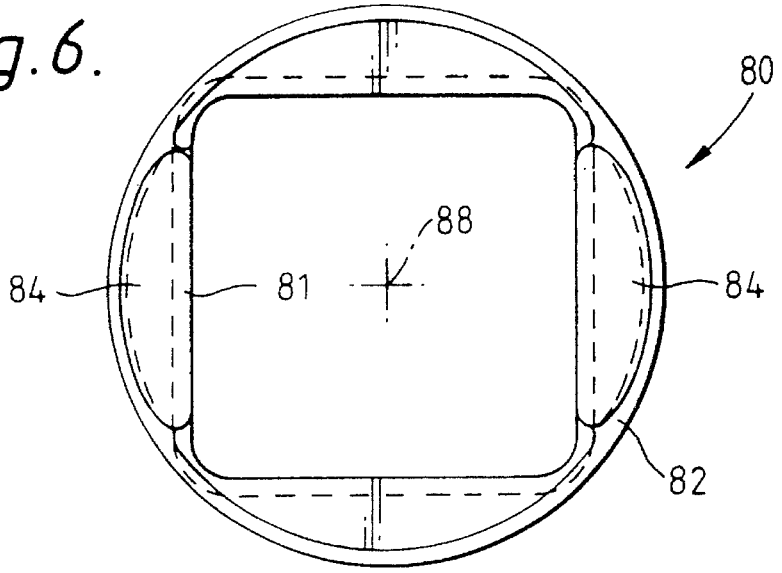
FIG. 6 is a plan view of a sleeve of a mounting bracket in accordance with the preferred embodiment according to another aspect of the invention.
Figure 7:
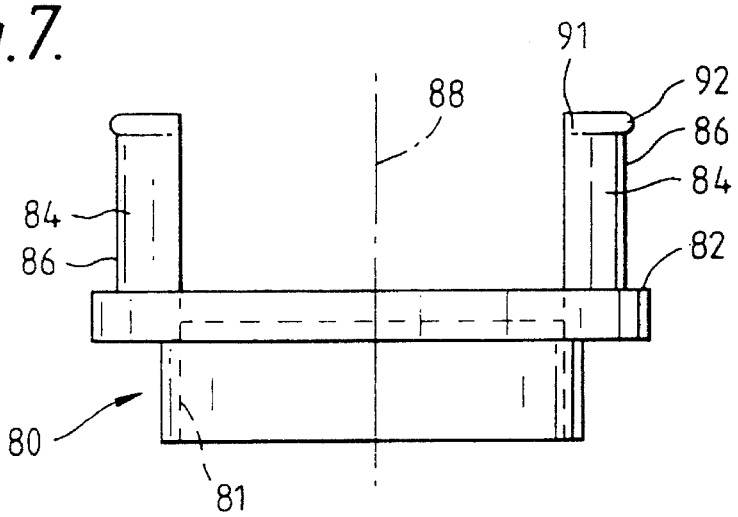
FIG. 7 is a side view of the mounting bracket of FIG. 1.
Figure 8:
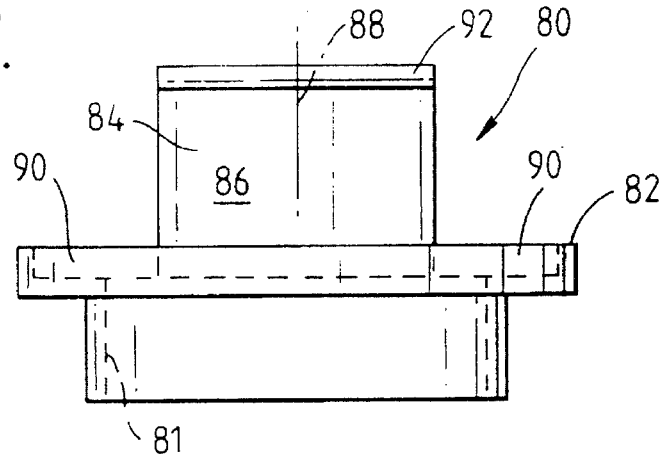
FIG. 8 is an end view of the mounting bracket of FIG. 1.

FIGS. 6, 7 and 8 show sleeve 80 with a bore 81 which is square in cross-section and corresponds in size to the external periphery of a post with which it is intended to be used. The sleeve 80 has a retaining flange 82 and a pair of projections 84. The external surfaces 86 of the projections 84 define part of an imaginary cylindrical surface having a longitudinal axis 88 which is coincident with the longitudinal axis of the bore 81. The sleeve 80 has recesses 90 extending between the projections 84. The free end 91 of each of the projections 84 has an external rib 92 extending therealong.

To form the mounting bracket, two such sleeves 80 are utilised, one sleeve 80 being inverted and rotated at 90° to the other, such that the projections 84 of one sleeve 80 extend towards the projections of the other sleeve 80. In the assembled configuration, the free end 91 and the rib 92 of each projection 84 extends into the corresponding recess 90. The external surfaces 86 of each of the projections 84 define part of an imaginary cylindrical surface thereby providing a mounting for components having a corresponding cylindrical internal surface.

The mounting may be used to mount coupling parts 93 as shown in FIGS. 9 and 10. Each coupling 93 comprises a collar 94 having a first cylindrical bore 95 which is slightly larger that the dimensions of the imaginary cylindrical surface. The coupling parts 93 are also provided with a lug 96 with a second cylindrical bore 97 having an axis 98 extending at 90° to the longitudinal axis 99 of the first cylindrical bore 95. A railing connection member 100 (see FIG. 12) is mounted to the lug 96 by a pin 101, the railing connection member being pivotable about axis 98. In use, a railing member (not shown) is attached to the free end 102 of the railing connection member 100.

FIG. 11 illustrates an alternative coupling 103 having slightly modified dimensions to coupling parts 93. This coupling 103 has lug member 104 to which a railing connection member 105 is pivotally connected utilising a hollow rivet.

Figure 12:
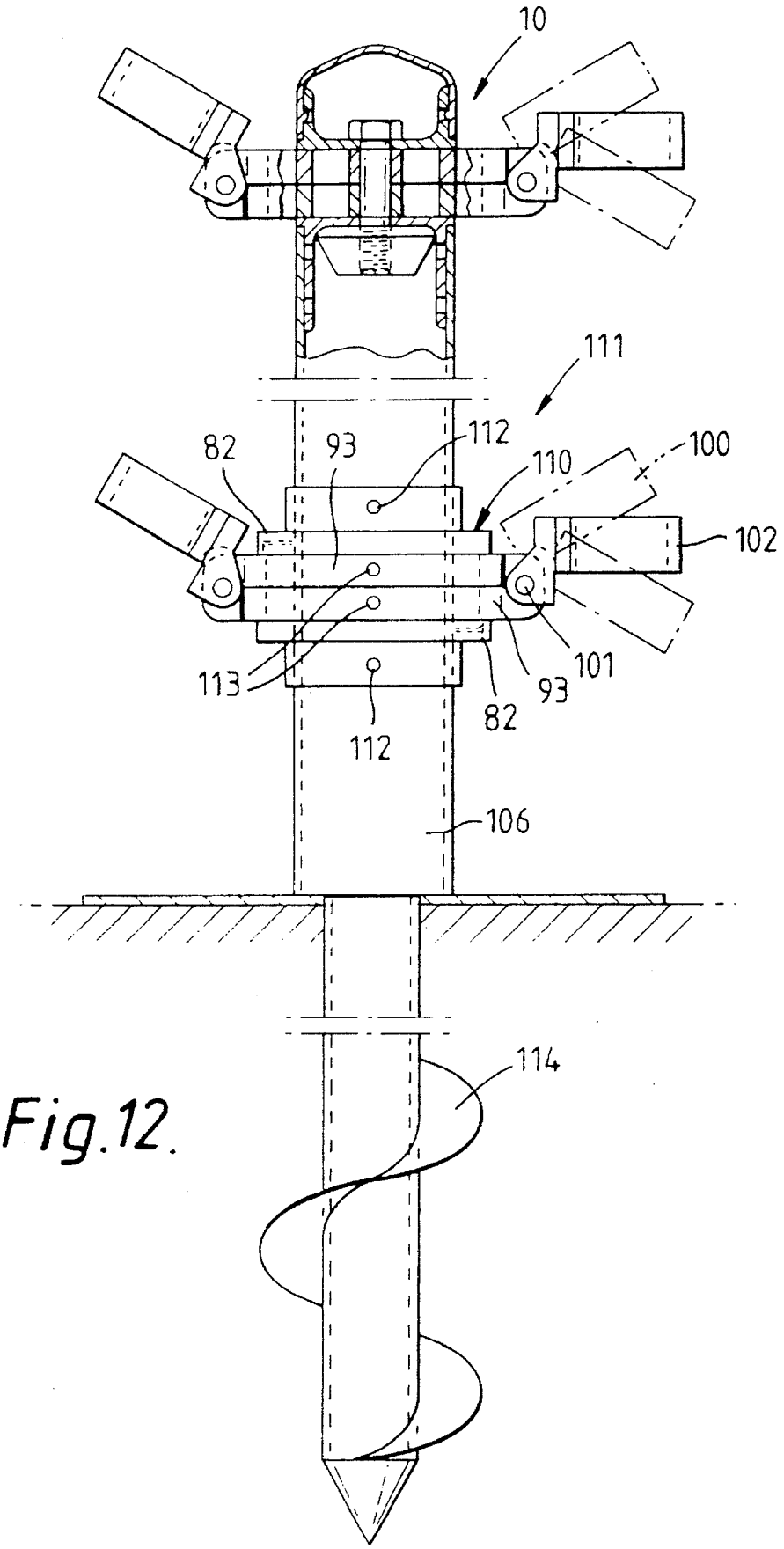
FIG. 12 is a partial sectional side view of the mounting bracket of FIG. 1 and the couplings of FIG. 4 in use.

FIG. 12 illustrates a fence post 106 in which two mounting brackets 110 are utilised in order to mount lower railing members (not shown) to the fence post 106. Coupling 10 is constructed generally as shown in FIG. 2 and positioned at an upper end of the post 106. Each mounting bracket comprises a pair of sleeves 80 and numerals used in previous figures illustrate the like parts. The sleeves 80 are assembled as described above but with two couplings 26 between the retaining flanges 82 to form a mounting assembly 111. The mounting assembly 111 is snap fitted together when it is at the desired location along post 106 and the sleeves 80 are then fixed to the post 106 by fastening members 112.

Each of the coupling parts 93 may then be rotated to the desired orientation. When this is achieved the coupling parts 93 are fixed with respect to the post 106 and sleeves 80 by fastening members 113.

The fence post 106 is set in a concrete footing in the ground (not shown) or fixed to the ground by means of auger 114. The post utilises the mounting assembly 111 as hereinbefore described to mount lower railing members (not shown) to the post 106. An assembly 111 may also be used at an upper end of the post 106. Alternatively, a mounting like that shown in FIG. 2 may be used at that location.

Figure 13:
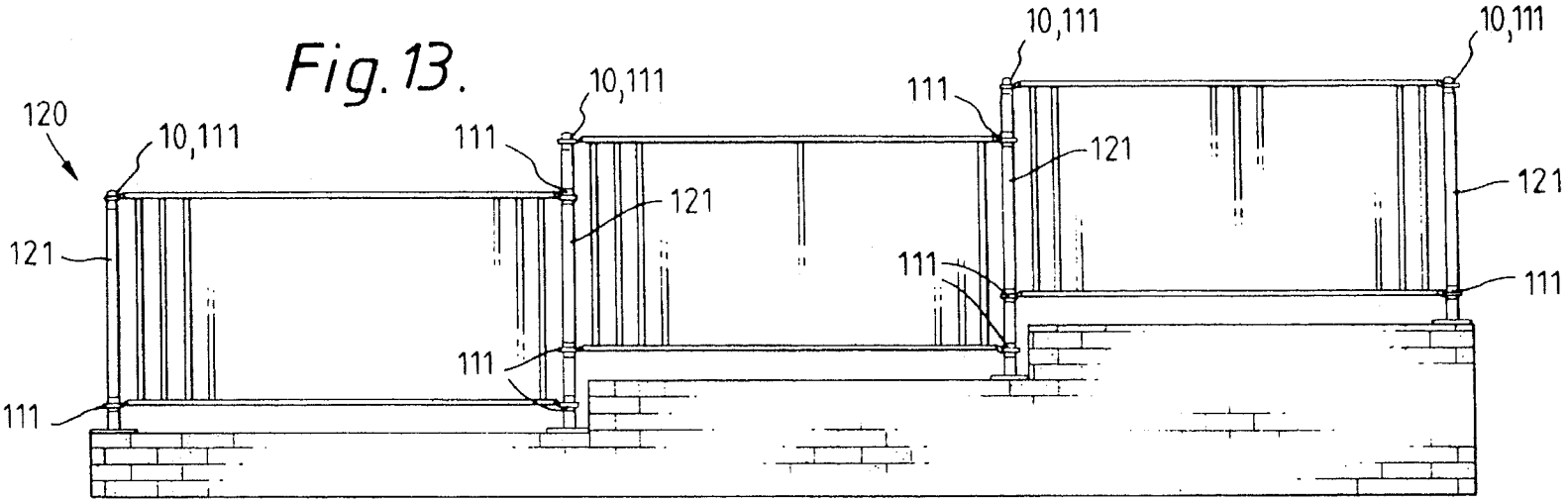
FIG. 13 illustrates the mounting brackets of FIG. 12 in use.

FIG. 13 illustrates a stepped fence arrangement 120 utilising mounting assemblies 111 at intermediate and lower locations along fence posts 121. It is desirable to use the mounting assemblies 111 in these locations thereby avoiding the need to break the post 70 into smaller segments. Fence couplings 10 or 50 (FIGS. 2 and 4) may be used at the top end of each fence post 121.

Figure 14:
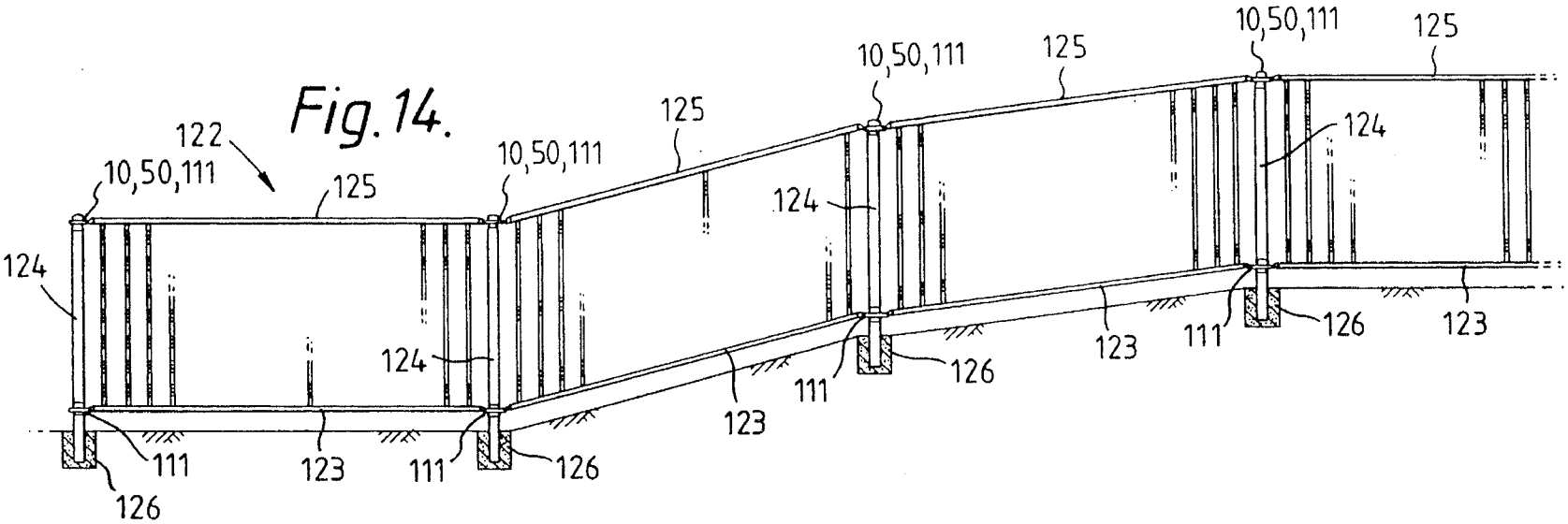
FIG. 14 illustrates the mounting brackets of FIG. 12.

FIG. 14 illustrates a sloping fence arrangement 122 with mounting assemblies 111 used to mount lower railing members 123 to the fence posts 124. Fence couplings 10, 50 or 111 may be used to mount upper railing members 125. In this arrangement each fence post 124 is mounted in a concrete footing 126 in the ground 127.

Figure 15:
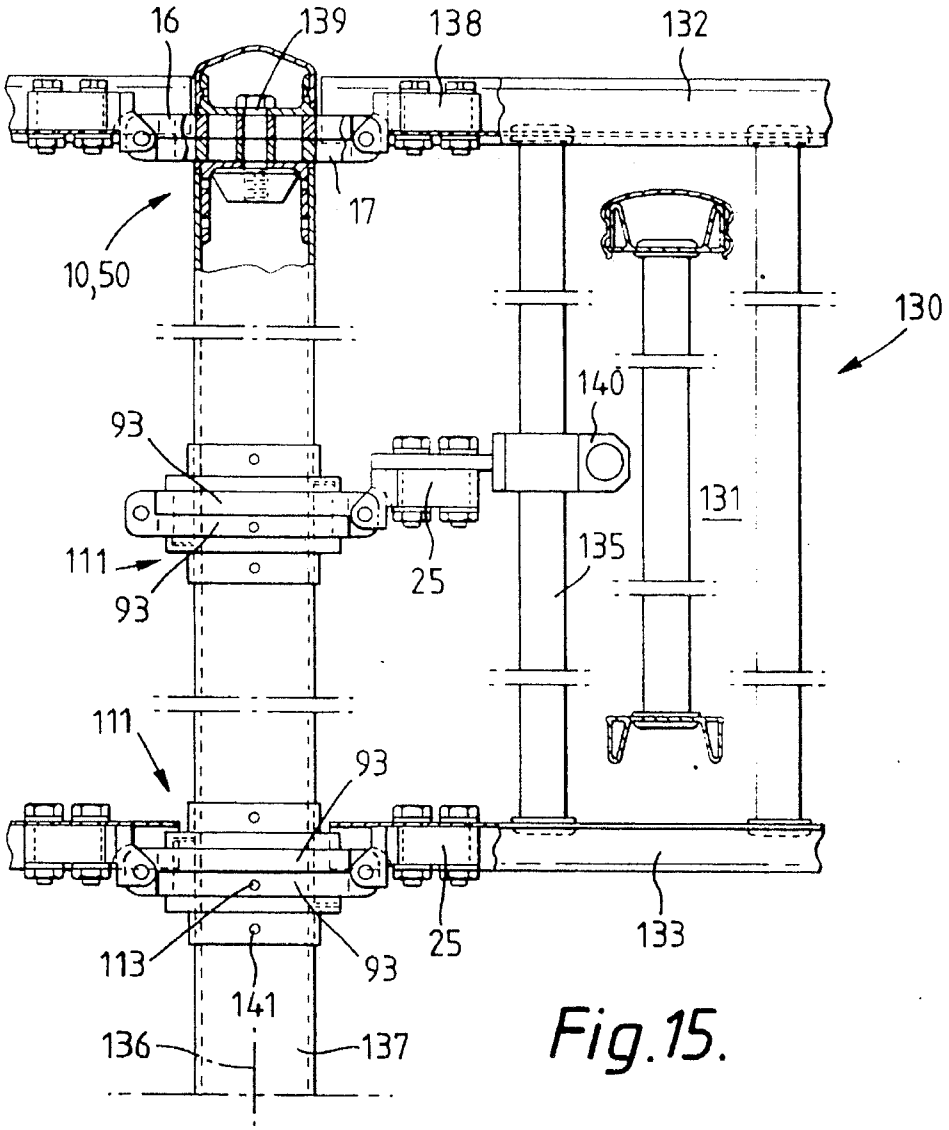
FIG. 15 illustrates the use of the mounting brackets and couplings as illustrated previously in a gate assembly.

FIG. 15 illustrates a gate assembly 130 comprising a gate portion 131 having an upper rail 132 and a lower rail 133 with uprights 135 extending therebetween. The gate portion 131 is swingable about the longitudinal axis 136 of support post 137 of square cross-section. Fence coupling 10 or 50 and two mounting assemblies 111 are used to swingably mount the gate portion 131 to the support post 137. The fence coupling 10, 50 is mounted to the top end of support post 137. Lower plate 17 of coupling 10 has railing connection member 138 connected to upper rail 132. The fastening assembly 139 is tightened so as to allow lower plate 17 of coupling 10 to pivot about the longitudinal axis 136. The upper plate 16 is held against rotation by virtue of its connection to the fencing structure (not shown).

The lower rail 133 is connected to railing connection member 25 which is connected to the upper of a pair of couplings 93 associated with the lower of the mounting assemblies 111. The lower of the pair of couplings 93 is pivotable about longitudinal axis 136. The lower coupling may be fixed against rotation by fastening member 113.

Intermediate of support post 137 is a further mounting assembly 111 with a pair of couplings 93. The upper of couplings 93 has railing connection member 25 which is connected to yoke member 140 which grips the upright 135 adjacent to the support post 137. The upper one of the pair of couplings 93 is pivotable about longitudinal axis 136 while the lower coupling may be held against rotation by fastening member 141.

The gate assembly 130 as described above utilises a support post 137 of square cross-section.

Figure 16:
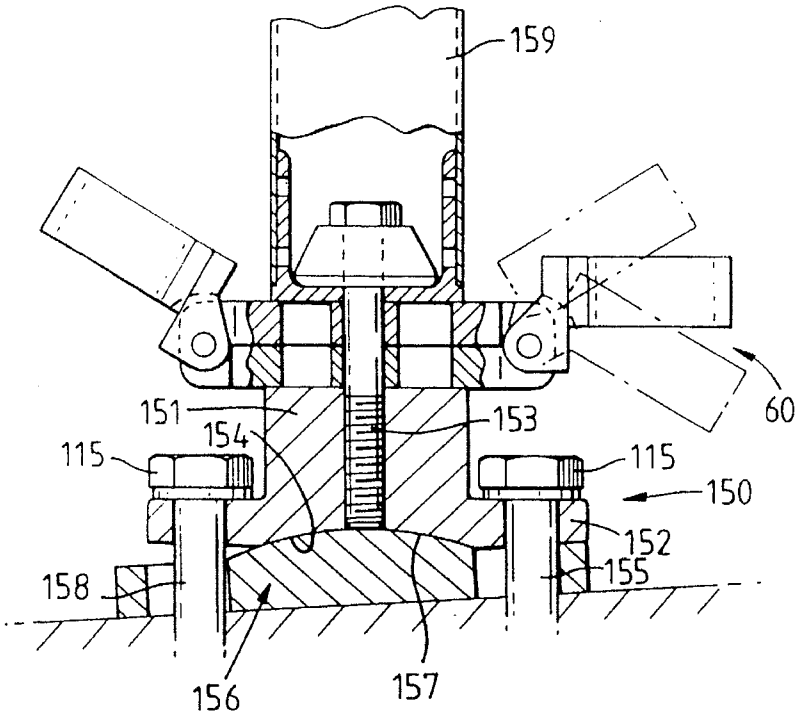
FIG. 16 is a sectional side view of a first preferred post support.

FIG. 16 illustrates a first preferred foot portion 150 having a cylindrical body 151 with an outwardly extending annular flange 152. The body has a threaded bore 153 extending therethrough and a concave part spherical surface 154. The flange 152 has three spaced apertures 155 extending therethrough.

Mounting block 156 is shown which is intended to be used in conjunction with the above described foot portion 150. The mounting block 156 is plate like in form with a central convex part spherical surface 157 corresponding in degree of curvature to concave surface 154. The mounting block 156 also has three spaced apertures 158, which in use align with the apertures 107 of the foot portion 100. In practice, the apertures 158 are larger than apertures 155 to allow for a degree of misalignment as the foot portion 150 and the mounting block 156 slide relative to each other.

The foot portion 150 may be constructed with the body 151 configured so as to be attachable to post 159 in some way other than as illustrated.

Figure 17:
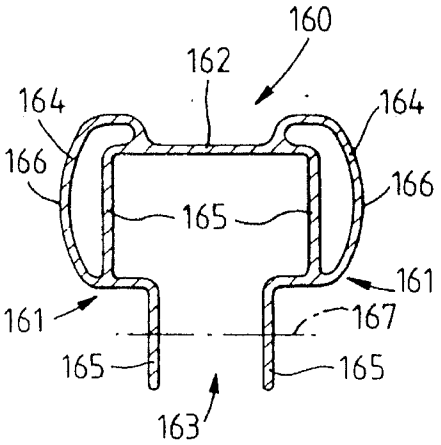
FIG. 17 is a cross-sectional view of a channel member.

FIG. 17 illustrates the preferred form for both the upper and lower channel members. The channel member 160 comprises opposed side walls 161 connected by a web member 162, the walls 161 defining an opening 163 therebetween. Each of the side walls 161 comprise a first portion 164 adjacent the web member 162 and a second portion 165 remote from the web member 162. Each of the first portions 164 are hollow, the inner surface 165 being planar and the outer surface 166 being curved for aesthetic appeal. The spacing between the first portions 164 is sufficient to receive a railing connection member (not shown) as described previously in connection with the mounting assembly 111, 50 or 10. The spacing between the second portions 162 is less than that of the first portions 164 but sufficient to receive a standard width of barrier material such as palings or pickets. A fastening member (not shown) may be inserted through the second portions 165 and the barrier material along axis 167 to secure the barrier material. Where there are discrete elongate members such as palings it is envisaged that one in three members will be secured by a fastening member.

Figure 18:
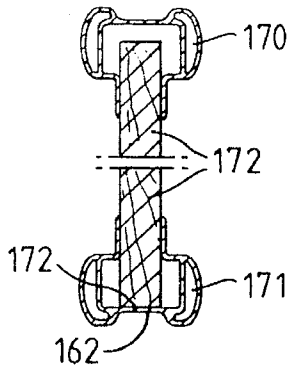
FIG. 18 is a sectional view of a barrier construction using timber palings.

FIG. 18 illustrates a fence construction with upper channel 170 and lower channel 171 with timber palings 172 extending from within the upper chanel 170 through the opening 163 thereof of the lower channel 171 to within the lower channel 171. Note that the lower edge 172 of the palings rest on the web member 162. This feature facilitates easy alignment of the palings.

Figure 19:
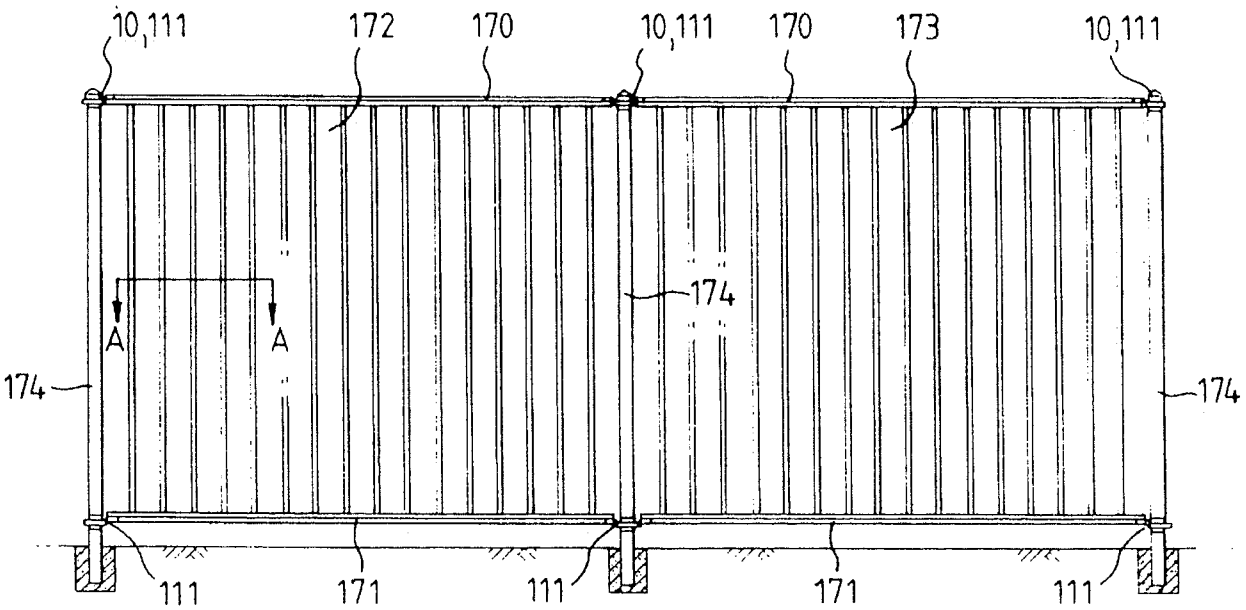
FIG. 19 is a side view of the barrier construction using timber palings and roll formed palings as in FIG. 18.

FIG. 19 illustrates a fence construction with timber palings 172 on the left half and sheet metal palings 173 on the right half. The upper 170 and lower 171 channel members extend between spaced upright posts 174. The upper channel members 170 are connected to the posts 174 by fencing couplings 10 or 111 as described in the abovementioned provisional application. The lower channel members are connected to the posts 174 by mounting assemblies 111 as described previously.

Figure 20:
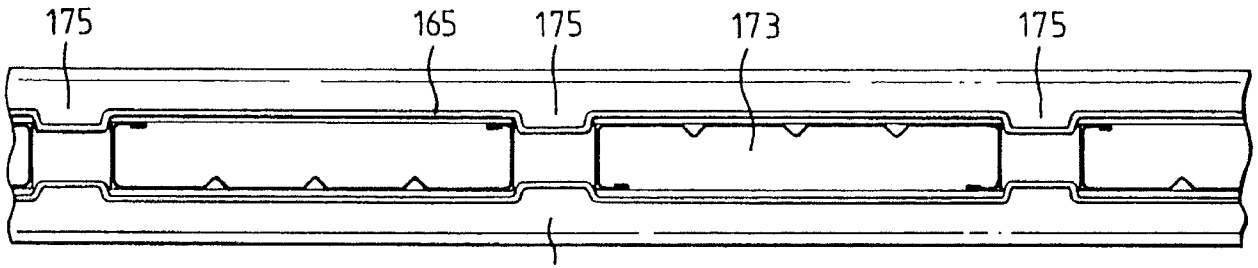
FIG. 20 is a sectional view AA as indicated in FIG. 19.

FIG. 20 illustrates how sheet metal palings 173 may be prevented from sliding relative to the channel members 170. At spaced locations along the channel members 170 the spacing between the second portion 165 of the side walls 161 is reduced to provide necked zones 175. An alternative to this may use spacer elements (not shown) between palings 173. A variety of different paling members or panels may be arranged extending between channels 170, 171.

I claim:

1. A fence comprising: a plurality of posts, each said post having a respective first and second coupling secured to an upper end of each of said post and said first and second couplings including a mounting portion to extend across the post, the mounting portion having a first and second part pivotally movable relative to one another about a first axis corresponding to the central longitudinal axis of the post and capable of being locked against relative pivotal movement, first and second railing connection members pivotally coupled to each of the first and second parts of the mounting portion and movable respectively about a second and third axis extending transversely of the first and second railing connection members, a mounting bracket for attaching the coupling to the post, the mounting bracket having a pair of sleeves each with an internal periphery corresponding to an external periphery of the post and a retaining member, each of the sleeves having one or more projections such that the projections of the sleeves extend towards each other, said second coupling secured to each said post adjacent a lower end of the posts and upper and lower railing members extending between the first and second couplings.

2. The fence of claim 1 including paling members extending between the upper and lower railing members.

3. The fence of claim 1 including panels extending between the upper and lower railing members.

4. A coupling for attaching railings to a post, the coupling comprising: a mounting portion to extend across the post, the mounting portion having a first and second part pivotally movable relative to one another about a first axis corresponding to the central longitudinal axis of the post and capable of being locked against relative pivotal movement, first and second railing connection members pivotally coupled to each of the first and second parts of the mounting portion and movable respectively about a second and third axis extending transversely of the first and second railing connection members, a mounting bracket for attaching the coupling to the post, the mounting bracket having a pair of sleeves each with an internal periphery corresponding to an external periphery of the post and a retaining member, each of the sleeves having one or more projections such that the projections of the sleeves extend towards each other, wherein the connection members being adapted for attachment to the railings.

5. The coupling of claim 4 wherein the parts of the mounting portion are locked relative to each other by a fastener extending along at right angles to said second and third axes about which the railing connection members pivot.

6. The coupling of claim 4 wherein the first and second parts of the mounting portion have complementary engagements and the first and second parts of the mounting portion pivot relative to one another about an axis extending through the complementary engagements.

7. The coupling of claim 6 wherein the complementary engagements comprise engaging extensions extending outwardly and a fastener extends through the extensions to connect the first and second parts of the mounting portion to each other for said relative pivotal movement.

8. The coupling of claim 4 wherein adjacent surfaces of the parts of the mounting portion have complementary mating grooves and ridges which extend radially relative to the parts.

9. The coupling of claim 4 wherein the parts of the mounting portion are substantially circular.

10. The coupling of claim 4 wherein the parts of the mounting portion are substantially annular.

11. The coupling of claim 4 wherein the retaining member is an annular flange.

12. The coupling of claim 4 in which each sleeve has two diametrically opposed arcuate projections.

13. The coupling of claim 11 wherein fasteners extend through the annular flanges to secure the sleeves to the post and fasteners extend through the first and second parts of the mounting portion to secure the first and second parts of the mounting portion to the sleeves.

14. The coupling of claim 13 wherein the sleeves have a square internal periphery.

* * * * *